US010878777B2

(12) United States Patent
Hwang et al.

(10) Patent No.: US 10,878,777 B2
(45) Date of Patent: Dec. 29, 2020

(54) ORGANIC LIGHT EMITTING DISPLAY DEVICE AND METHOD FOR SETTING GAMMA REFERENCE VOLTAGE THEREOF

(71) Applicant: SAMSUNG DISPLAY CO., LTD., Yongin-si (KR)

(72) Inventors: Kyung Ho Hwang, Yongin-si (KR); Young Seob Kim, Yongin-si (KR); Ji Tae Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 92 days.

(21) Appl. No.: 15/162,740

(22) Filed: May 24, 2016

(65) Prior Publication Data

US 2017/0076695 A1 Mar. 16, 2017

(30) Foreign Application Priority Data

Sep. 10, 2015 (KR) ..... 10-2015-0128619

(51) Int. Cl.

| | |
|---|---|
| ***G09G 5/10*** | (2006.01) |
| ***G09G 3/3225*** | (2016.01) |
| ***G09G 3/3291*** | (2016.01) |

(52) U.S. Cl.

CPC ..... *G09G 5/10* (2013.01); *G09G 3/3225* (2013.01); *G09G 3/3291* (2013.01); *G09G 2310/027* (2013.01); *G09G 2320/0276* (2013.01); *G09G 2330/028* (2013.01)

(58) Field of Classification Search

None

See application file for complete search history.

(56) References Cited

U.S. PATENT DOCUMENTS

| | | | | |
|---|---|---|---|---|
| 2008/0007494 | A1* | 1/2008 | Kim | G09G 3/3225 345/77 |
| 2010/0033413 | A1* | 2/2010 | Song | G09G 3/3655 345/89 |
| 2014/0165022 | A1 | 6/2014 | Stevens | |
| 2015/0054806 | A1* | 2/2015 | Abe | G09G 3/36 345/207 |

* cited by examiner

*Primary Examiner* — Andre L Matthews

(74) *Attorney, Agent, or Firm* — Lewis Roca Rothgerber Christie LLP

(57) ABSTRACT

An organic light emitting display device includes a gamma reference voltage setter to set a gamma reference voltage, a gamma reference voltage generator to generate a gamma reference voltage set by the gamma reference voltage setter, and a gamma voltage generator to generate a gamma voltage based on the gamma reference voltage. The gamma reference voltage setter sets the gamma reference voltage to a first temporary value, increases the first temporary value by a first delta value, searches a second temporary value at which luminance of the display panel is less than a preset value, and sets the gamma reference voltage based on the searched second temporary value.

18 Claims, 7 Drawing Sheets

ORGANIC LIGHT EMITTING DISPLAY DEVICE AND METHOD FOR SETTING GAMMA REFERENCE VOLTAGE THEREOF

CROSS-REFERENCE TO RELATED APPLICATION

Korean Patent Application No. 10-2015-0128619, filed on Sep. 10, 2015, and entitled, "Organic Light Emitting Display Device and Method for Setting Gamma Reference Voltage Thereof," is incorporated by reference herein in its entirety.

BACKGROUND

1. Field

One or more embodiments described herein relate to an organic light emitting display device and a method for setting a gamma reference voltage for an organic light emitting device.

2. Description of the Related Art

A variety of displays have been developed. Examples include liquid crystal displays, plasma display panels, and organic light emitting displays. Organic light emitting displays are smaller, lighter, and thinner than other types of displays and have relatively low power consumption.

An organic light emitting display generates images based on data voltages applied to pixel electrodes. The data voltages are generated based on gamma voltages that reflect the gamma characteristics of the display. For example, a gray voltage corresponding to gradation of input image data may be output as a data voltage. The gray voltage may be generated based on a gamma reference voltage. However, current approaches for controlling the generation of images in an organic light emitting display degrade image quality and adversely affect reliability.

SUMMARY

In accordance with one or more embodiments, a method for setting a gamma reference voltage of an organic light emitting display device includes setting the gamma reference voltage to a first temporary value; searching a second temporary value while increasing the first temporary value by a first delta value, the second temporary value corresponding to a value at which luminance of the organic light emitting display device is less than a preset value; and setting the gamma reference voltage based on the searched second temporary value. The first temporary value may be 5V and/or the preset value may be 0.01. The first delta value may be 0.1V.

Searching the second temporary value may include measuring luminance of the organic light emitting display device when the gamma reference voltage is the first temporary value; when the measured luminance is not less than the preset value, increasing the first temporary value by the first delta value; and measuring luminance of the organic light emitting display device when the gamma reference voltage corresponds to the first temporary value increased by the first delta value.

Setting the gamma reference voltage may include setting the gamma reference voltage by adding a preset offset value to the second temporary value, where the offset value is previously set as a value to compensate a difference between the second temporary value, at which luminance of the organic light emitting display device is less than the preset value, and a third temporary value at which luminance of the organic light emitting display device is 0.

After searching the second temporary value at which luminance of the organic light emitting display device is less than the preset value, the method may include, when the luminance of the organic light emitting display device is less than the preset value, reducing the second temporary value by a second delta value and searching a forth temporary value at which luminance of the organic light emitting display device is greater than or equal to the preset value. The second delta value may be a value less than the first delta value.

The method may include setting a transistor voltage of the organic light emitting display device by adding a preset margin value to the set gamma reference voltage. The transistor voltage may be a transistor OFF voltage. The transistor may be a PMOS transistor. The gamma reference voltage may be set to be different for each of a plurality of organic light emitting display devices.

In accordance with one or more other embodiments, an organic light emitting display device includes a display panel including a plurality of pixels connected to a plurality of data lines and a plurality of scan lines intersecting the data lines; a gamma reference voltage setter to set a gamma reference voltage; a gamma reference voltage generator to generate a gamma reference voltage set by the gamma reference voltage setter; a gamma voltage generator to generate a gamma voltage based on the gamma reference voltage; and a data driver to provide a data voltage generated based on the gamma voltage to a corresponding one of the data lines, wherein the gamma reference voltage setter is to set the gamma reference voltage to a first temporary value, increase the first temporary value by a first delta value, search a second temporary value at which luminance of the display panel is less than a preset value, and set the gamma reference voltage based on the searched second temporary value. The first delta value may be 0.1V.

The gamma reference voltage setter may set the gamma reference voltage by adding a preset offset value to the second temporary value, where the offset value is previously set as a value to compensate a difference between the second temporary value, at which luminance of the organic light emitting display device is less than the preset value, and a third temporary value at which luminance of the organic light emitting display device is 0.

After searching the second temporary value at which luminance of the organic light emitting display device is less than the preset value and when the luminance of the organic light emitting display device is less than the preset value, the gamma reference voltage setter may reduce the second temporary value by a second delta value and search a forth temporary value at which luminance of the organic light emitting display device is greater than or equal to the preset value. The second delta value may be a value less than the first delta value. The gamma reference voltage setter may set a transistor voltage of the organic light emitting display device by adding a preset margin value to the set gamma reference voltage. The gamma reference voltage may set to be different for each of a plurality of organic light emitting display devices.

In accordance with one or more other embodiments, a controller includes a processor to set a gamma reference voltage; a gamma reference voltage generator to generate a gamma reference voltage set by the processor; and a gamma voltage generator to generate a gamma voltage based on the gamma reference voltage, wherein the processor is to set the gamma reference voltage to a first temporary value, increase the first temporary value by a first delta value, search a second temporary value at which luminance of the display panel is less than a preset value, and set the gamma reference voltage based on the searched second temporary value.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
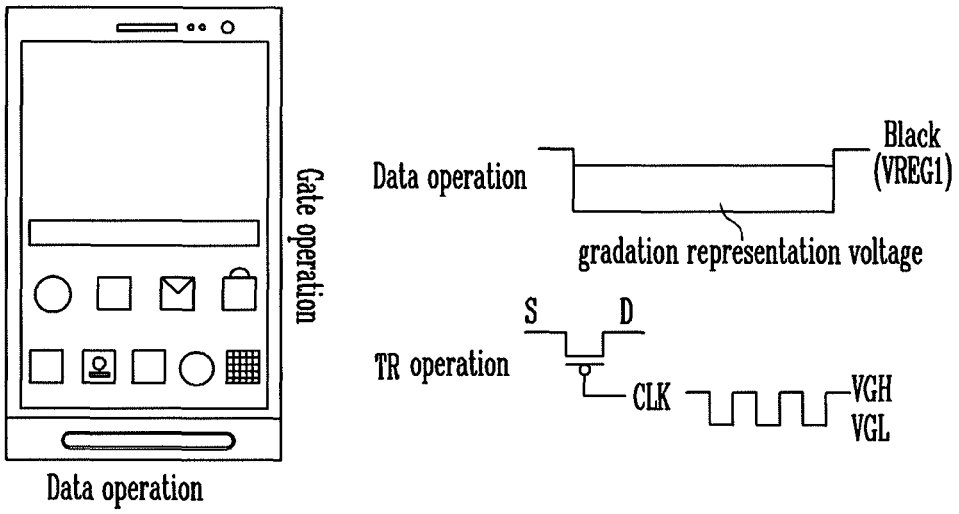
FIG. 1 (Related Art)
FIG. 1 illustrates one type of organic light emitting display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

Figure 3:
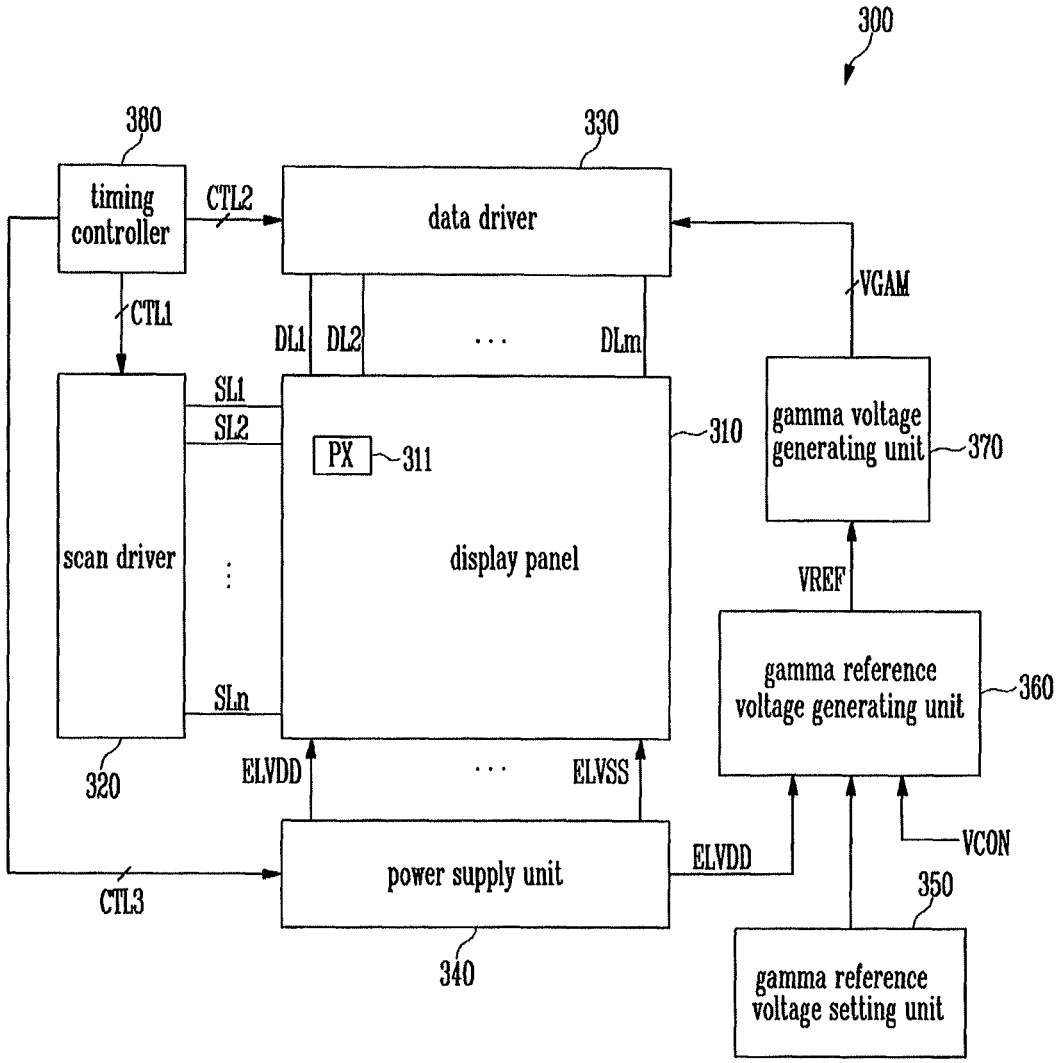
FIG. 3 illustrates an embodiment of an organic light emitting display device.

FIG. 3 illustrates an embodiment of an organic light emitting display device 300 which includes a display panel 310, a scan driver 320, a data driver 330, a power supply unit 340, a gamma reference voltage setting unit 350, a gamma reference voltage generating unit 360, a gamma voltage generating unit 370, and a timing controller 380. The organic light emitting display device 300 may operate, for example, in an analog driving manner. At least the a gamma reference voltage setting unit 350, a gamma reference voltage generating unit 360, a gamma voltage generating unit 370 may be considered to be a controller.

The display panel 310 includes a plurality of pixels P electrically connected to a plurality of scan lines SL and a plurality of data lines DL. The scan lines SL extend in a first direction and the data lines DL extend in a second direction intersecting the first direction D1.

Each pixel P may include, for example, a switching transistor, a liquid crystal capacitor (CLC) electrically connected to the switching transistor, a storage capacitor, a driving transistor, and an organic light emitting diode (OLED).

The switching transistor has a first terminal connected to one of the data lines DL1, . . . , DLm, a second terminal connected to a first node, and a gate terminal connected to one of the scan lines SL1, . . . , SLn. The storage capacitor has a first terminal connected to a first source voltage ELVDD and a second terminal connected to the first node. The driving transistor has a first terminal connected to the first source voltage ELVDD, a gate terminal connected to the first node, and a second terminal connected to an anode electrode of the OLED. The OLED has a cathode electrode connected to a second source voltage ELVSS and an anode electrode connected to the second terminal of the driving transistor. Each pixel P may have a different structure in another embodiment. The pixels P may be disposed in a matrix form.

The scan driver 320 provide a scan signal to the pixels P in the display panel 310 through the scan lines SL1, . . . , SLn. The scan driver 320 may include at least one scan driving integrated circuit (IC), may be positioned on at least one side surface of the display panel 310, and may be connected to the display panel 310, for example, in a chip-on-flexible printed circuit (COF), a chip-on-glass (COG), or a flexible printed circuit (FPC) manner.

The data driver 330 provide data signals corresponding to an image signal to the pixels P in the display panel 310 through the data lines DL1, . . . , DLm. The data driver 330 may include at least one data driving IC, may be positioned on at least one side surface of the display panel 310, and may be connected to the display panel 310, for example, in a COF, COG, or FPC manner.

The power supply unit 340 provides the first source voltage ELVDD and the second source voltage ELVSS to the pixels P in the display panel 310. The second source voltage ELVSS may have a voltage level lower than the first source voltage ELVDD. The power supply unit 340 may include at least one power supply circuit. The second source voltage ELVSS may be a reference (e.g., ground) voltage.

In order to set a gamma reference voltage optimized (or predetermined) for each organic light emitting display device 300, the gamma reference voltage setting unit 350 measures luminance of the organic light emitting display device 300 and sets a gamma reference voltage VREG1 of the organic light emitting display device 300 based on the luminance measurement result.

Figure 4:
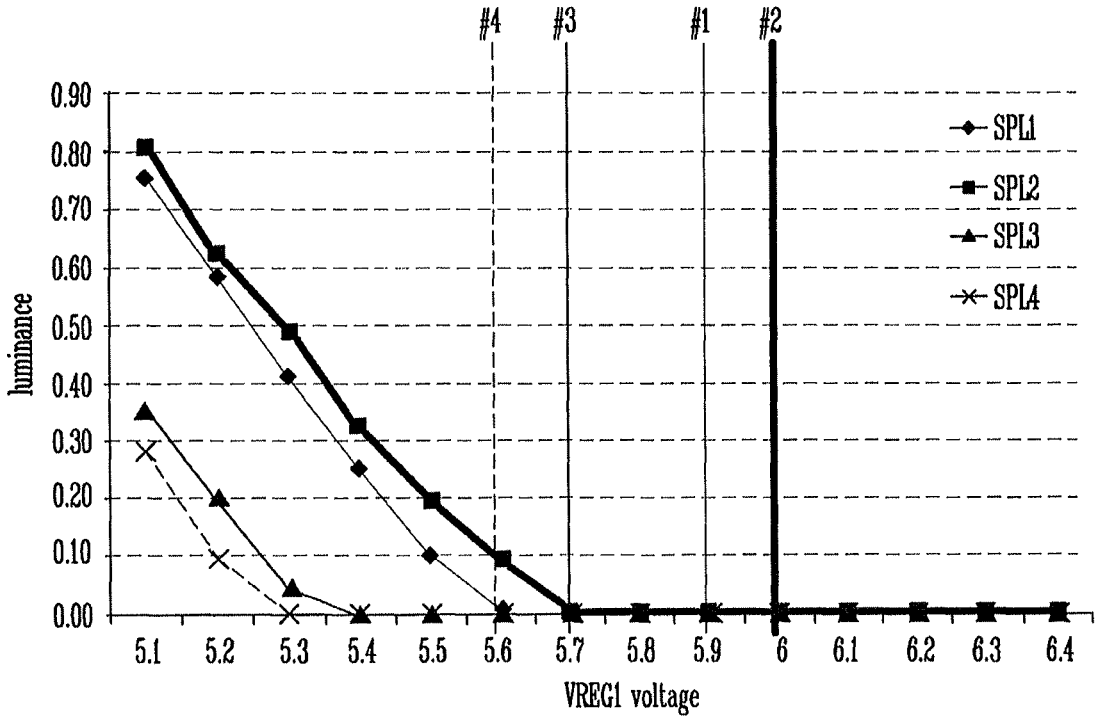
FIG. 4 illustrates an embodiment of a method for setting a gamma reference voltage.

Referring to FIG. 4, black voltages may be different for different organic light emitting display devices. Thus, the gamma reference voltage VREG1 may be set to be different for different organic light emitting display devices by the gamma reference voltage setting unit 350, as illustrated, for example, in FIG. 4. Also, the gamma reference voltage setting unit 350 may set an ON/OFF voltage of the transistor of the display panel 310 based on the preset gamma reference voltage VREG1. The gamma reference voltage setting unit 350 may be separately provided or may be in power supply unit 340.

The gamma reference voltage generating unit 360 may generate a gamma reference voltage VREG1 based on a value corresponding to the gamma reference voltage VREG1 set by the gamma reference voltage setting unit 350. Since the gamma reference voltage VREG1 may be set to be different for different organic light emitting display devices by the gamma reference voltage setting unit 350, the gamma reference voltage generating unit 360 may generate voltages having different values for each organic light emitting device.

The gamma voltage generating unit 370 generates gamma voltages VGAM based on the gamma reference voltage VREG1 and provides the gamma voltages to the data driver 330. Since the gamma voltage generating unit 370 generates the gamma voltages VGAM based on the gamma reference voltage VREG1, the gamma voltages VGAM may be changed according to a change in the gamma reference voltage VREG1. For example, when the gamma reference voltage VREG1 is increased, the gamma voltages VGAM may be increased. Also, when the gamma reference voltage VREG1 is reduced, the gamma voltages VGAm may be reduced.

The data driver 330 generate data signals for the pixels P in the display panel 310 based on the gamma voltages VGAM from the gamma voltage generating unit 370. The data driver 330 outputs the data signals to corresponding ones of the data lines DL.

A method for setting the gamma reference voltage VREG1 of the organic light emitting display device 300 by the gamma reference voltage setting unit 350 according to one embodiment will now be described.

Figure 5:
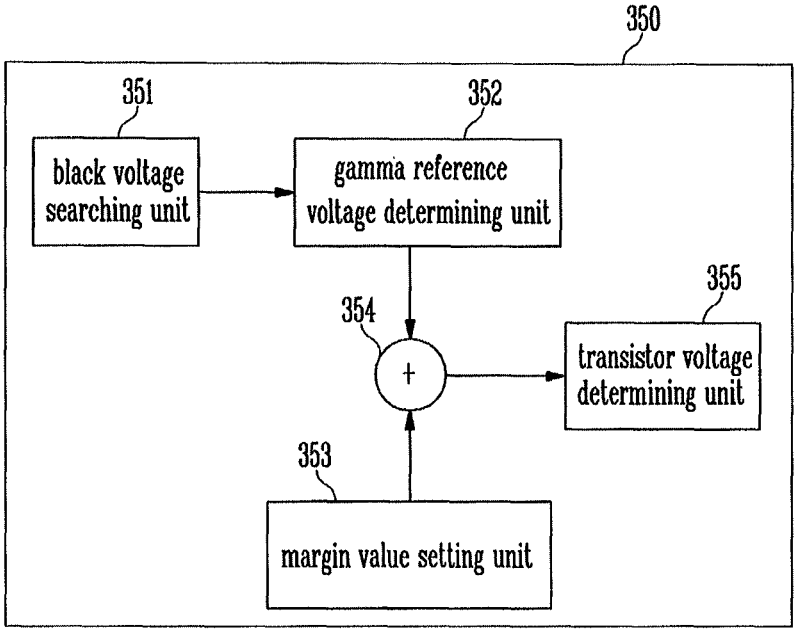
FIG. 5 illustrates an embodiment of a gamma reference voltage setting unit.

FIG. 5 illustrates an embodiment of the gamma reference voltage setting unit 350 which includes a black voltage searching unit 351, a gamma reference voltage determining unit 352, a margin value setting unit 353, an adding unit 354, and a transistor voltage determining unit 355.

The black voltage searching unit 351 measures a black voltage of the organic light emitting display device 300 and outputs the black voltage to the gamma reference voltage determining unit 352. In one embodiment, the black voltage searching unit 351 may measure luminance of the organic light emitting display device 300 in order to measure black voltage.

The gamma reference voltage determining unit 352 determines a gamma reference voltage VREG1 for the organic light emitting display device 300 based on the black voltage from the black voltage searching unit 351. The gamma reference voltage determining unit 352 may determine the gamma reference voltage VREG1, for example, by adding a preset offset value to the measured black voltage from the black voltage searching unit 351. The gamma reference voltage determining unit 352 may then set the determined gamma reference voltage VREG1 in the display device 300.

The margin value setting unit 353 may determine a margin value for setting a transistor ON/OFF voltage of the organic light emitting display device 300. The margin value may be set to a predetermined value, e.g., 0.1V or 0.2V.

The adding unit 354 adds the gamma reference voltage VREG1 determined by the gamma reference voltage determining unit 352 and the margin value determined by the margin value setting unit 353 and outputs the added value to the transistor voltage determining unit 355.

The transistor voltage determining unit 355 may determine an OFF voltage of a transistor as, or based on, the value resulting from adding the margin value to the gamma reference voltage VREG1 from the adding unit 354. For a PMOS transistor, for example, the OFF voltage may correspond to VGH. The transistor voltage determining unit 355 may set the determined transistor OFF voltage in the organic light emitting display device 300.

The transistor voltage determining unit 355 may also determine an ON voltage of the transistor. In one embodiment, the transistor voltage determining unit 355 may perform a separate algorithm for determining the ON voltage of the transistor using the gamma reference voltage VREG1. A calculation module other than the adding unit 354 may be provided in the gamma reference voltage setting unit 350 to determine the transistor ON voltage.

An embodiment of a method for setting the gamma reference voltage VREG1 of the gamma reference voltage setting unit 350 will be described using a more specific example of a method for searching for a black voltage of the black voltage searching unit 351. The gamma reference voltage setting unit 350 may perform all of the operations of the method. In another embodiment, one or more of the operations of the method may be performed by components provided, for example, in the gamma reference voltage setting unit 350 or a separate unit.

Figure 6:
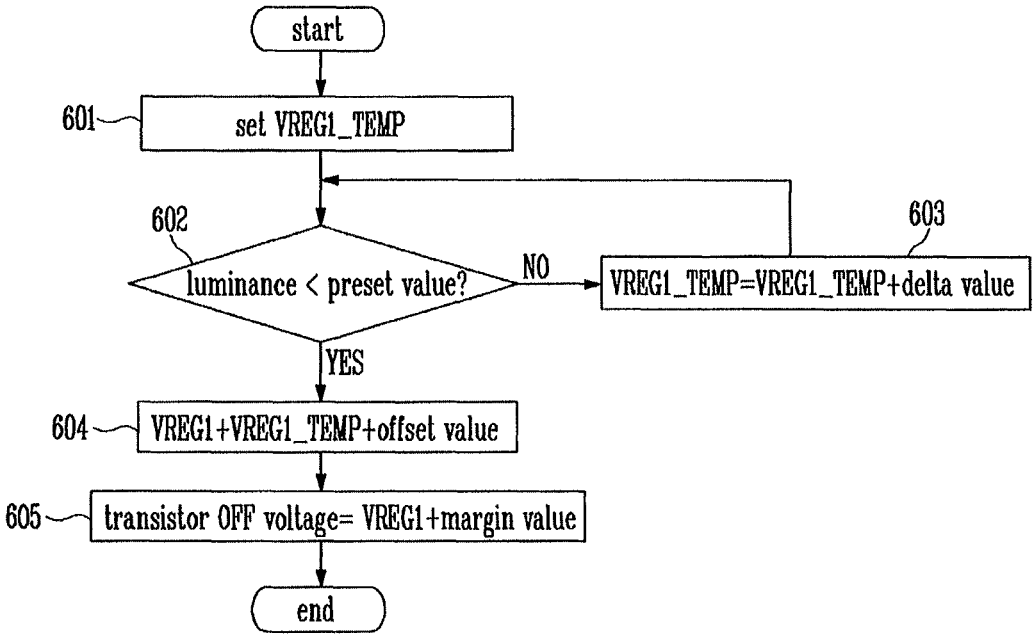
FIG. 6 illustrates another embodiment of a method for setting a gamma reference voltage.

FIG. 6 illustrates an embodiment of a method for setting a gamma reference voltage. In this method, the gamma reference voltage setting unit 350 determines the gamma reference voltage VREG1 individually set for the organic light emitting display device 300. The gamma reference voltage setting unit 350 measures a black voltage of the organic light emitting display device 300 and sets the gamma reference voltage VREG1 with respect to the corresponding organic light emitting display device 300 according to the measured black voltage.

Referring to FIG. 6, first, the gamma reference voltage setting unit 350 sets a temporary value (VREG1_TEMP) of a gamma reference voltage (operation 601). The temporary value may be set to a sufficiently low value such that a black voltage may be properly measured with respect to the organic light emitting display device 300. In one embodiment, the gamma reference voltage setting unit 350 may set the temporary value (VREG1_TEMP) of the gamma reference voltage to 5V.

Next, when the gamma reference voltage VREG1 is set to a temporary value, the gamma reference voltage setting unit 350 determines whether luminance of the organic light emitting display device 300 is less than a preset value (operation 602).

When the gamma reference voltage VREG1 is set to a temporary value, the gamma reference voltage setting unit 350 may measure luminance of the organic light emitting display device 300 and determine whether the measured luminance is less than a preset value. The preset value, as a reference for comparison, may be a value at which measured luminance is sufficiently low to display black, e.g., when a black voltage is reached, e.g., 0.01.

When the measured luminance is not less than the preset value, the gamma reference voltage setting unit 350 increases the temporary value (VREG1_TEMP) of the gamma reference voltage by a delta value (operation 603). The delta value may be a value previously set to determine whether luminance of the organic light emitting display device 300 is less than a preset value, while increasing the temporary value (VREG1_TEMP) of the gamma reference voltage. As the delta value decreases, the accuracy of the measured black voltage increases and black voltage measurement time is lengthened. Conversely, as the delta value increases, the accuracy of the black voltage decreases and the black voltage measurement time is shortened. Thus, the delta value may be set by taking into consideration the accuracy of black voltage measurement and a measurement time. The delta value may be set to 0.1 V, for example, or another value.

Based on the temporary value (VREG1_TEMP) of the gamma reference voltage increased by the delta value, the gamma reference voltage setting unit 350 measures luminance of the organic light emitting display device 300 again and then determines whether the luminance is less than a preset value. By repeating the foregoing operation, the gamma reference voltage setting unit 350 searches for a temporary value having a luminance that is less than the preset value. When operation 602 determines that a current or second temporary value, which is the initial or first temporary value that has been increased due to operation 603, has a luminance that is less than the preset value, that current temporary value is output to operation 604 to set the gamma reference voltage.

When the measured luminance is less than the preset value, the gamma reference voltage setting unit 350 adds the preset offset value to the temporary value at the time and determines the resultant value as reference voltage VREG1 (operation 604).

In at least one embodiment, a black voltage refers to a voltage when luminance of the organic light emitting display device 300 is 0. In some circumstances, it may be difficult to measure whether luminance of the organic light emitting display device 300 is 0. Thus, in actually measuring the black voltage, the black voltage may be measured using a certain value (e.g., the preset value mentioned above), not 0, determined as a state in which measured luminance is sufficiently low so the black voltage is reached. Thus, the measured black voltage may have a difference value compared with the black voltage that exists when luminance is 0. Thus, in one embodiment, in order to compensate for the difference in the black voltage generated due to the foregoing reason, the gamma reference voltage VREG1 may be determined by adding a preset offset value to a temporary value.

In addition, the gamma reference voltage setting unit 350 determines a transistor voltage by adding a preset margin value to the determined gamma reference voltage VREG1 (operation 605). In one embodiment, the gamma reference voltage setting unit 350 may determine an OFF voltage of the transistor. When the transistor is a PMOS transistor, the OFF voltage of the transistor may correspond to VGH.

Figure 7:
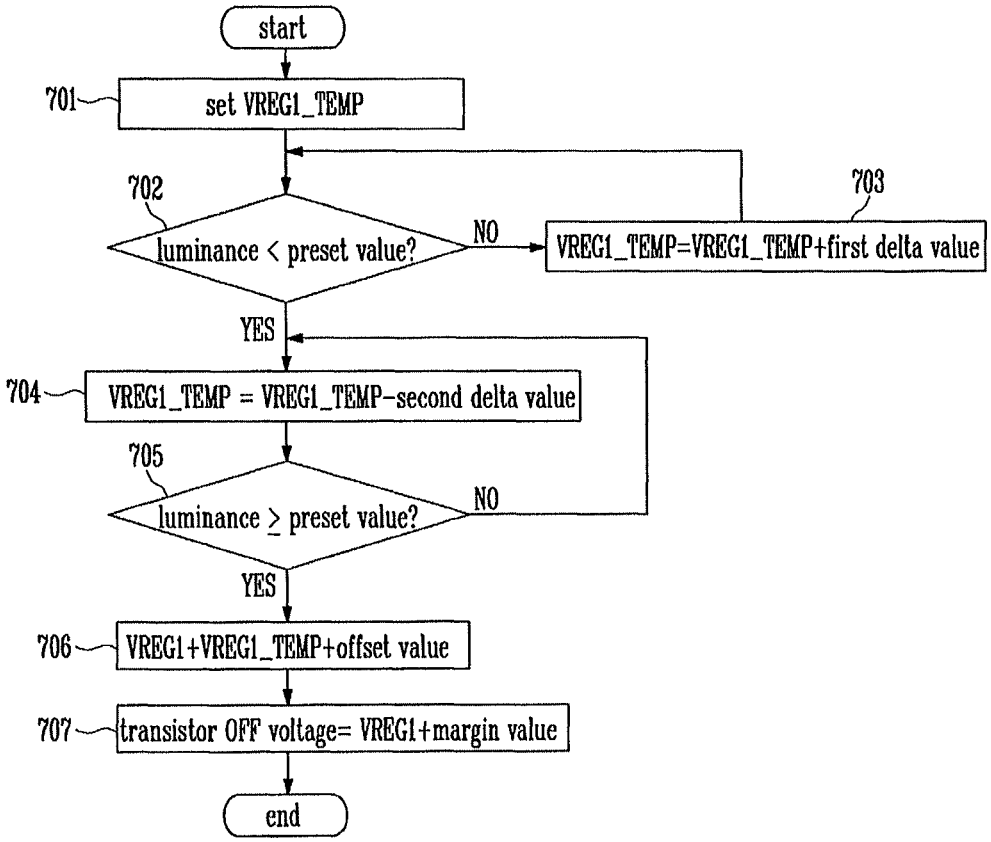
FIG. 7 illustrates another embodiment of a method for setting a gamma reference voltage.

FIG. 7 illustrates another embodiment of a method for setting a gamma reference voltage. Referring to FIG. 7, first, the gamma reference voltage setting unit 350 sets a temporary value (VREG1_TEMP) of a gamma reference voltage (operation 701). The temporary value may be set to a sufficiently low value such that a black voltage may be properly measured with respect to the organic light emitting display device 300. In one embodiment, the gamma reference voltage setting unit 350 may set the temporary value (VREG1_TEMP) of the gamma reference voltage to a predetermined voltage, e.g., 5V.

Next, when the gamma reference voltage VREG1 is set to a temporary value, the gamma reference voltage setting unit 350 determines whether luminance of the organic light emitting display device 300 is less than a preset value (operation 702).

When the gamma reference voltage VREG1 is set to a temporary value, the gamma reference voltage setting unit 350 may measure luminance of the organic light emitting display device 300 and determine whether the measured luminance is less than a preset value. The preset value, as a reference for comparison, may be a value at which measured luminance is sufficiently low to display black (e.g., when a black voltage is reached) such as, for example, 0.01.

When the measured luminance is not less than the preset value, the gamma reference voltage setting unit 350 increases the temporary value (VREG1_TEMP) of the gamma reference voltage by a first delta value (operation 703). The first delta value is a value previously set to summarize and measure a black voltage, while rapidly increasing the temporary value (VREG1_TEMP) of the gamma reference voltage. The first delta value may be set to a value greater than 0.1 V or another predetermined value.

Based on the temporary value (VREG1_TEMP) of the gamma reference voltage increased by the first delta value, the gamma reference voltage setting unit 350 measures luminance of the organic light emitting display device 300 again and determines whether the luminance is less than the preset value. By repeating the foregoing operation, the gamma reference voltage setting unit 350 searches for a temporary value having a luminance that is less than the preset value. When operation 702 determines that a current or second temporary value, which is the initial or first temporary value that has been increased due to operation 703, has a luminance that is less than the preset value, that current temporary value is output to operation 704 to set the gamma reference voltage.

When the measured luminance is less than the preset value, the gamma reference voltage setting unit 350 reduces the temporary value (VREG1_TEMP) of the gamma reference voltage by a second delta value (operation 704). The second delta value may be a value set to accurately measure a black value summarized and searched by the first delta value, while reducing the temporary value (VREG1_TEMP) of the gamma reference voltage. The second delta value may be set to a value less than the first delta value.

Thus, under some circumstances, the method for setting a gamma reference voltage value according to this embodiment may measure a black voltage accurately at a faster rate than the previous embodiment.

Thereafter, based on the temporary value (VREG1_TEMP) of the gamma reference voltage increased by the second delta value, the gamma reference voltage setting unit 350 determines whether the luminance of the organic light emitting display device 300 is greater than or equal to a preset value (operation 705).

When the measured luminance is not greater than or equal to the preset value, the gamma reference voltage setting unit 350 measures luminance of the organic light emitting display device 300 again, while reducing the temporary value (VREG1_TEMP) of the gamma reference voltage by the second delta value, and determines whether the luminance is greater than or equal to the preset value. While repeating the operation, the gamma reference voltage setting unit 350 searches a temporary value of luminance greater than or equal to the preset value.

When the measured luminance is greater than or equal to the preset value, the gamma reference voltage setting unit 350 adds the preset offset value to the temporary value at the time and determines the resultant value as a reference voltage VREG1 (operation 706).

In addition, the gamma reference voltage setting unit 350 determines a transistor voltage by adding a preset margin value to the determined gamma reference voltage VREG1 (operation 707). In one embodiment, the gamma reference voltage setting unit 350 may determine an OFF voltage of the transistor. For a PMOS transistor, the OFF voltage may correspond to VGH.

Figure 8:
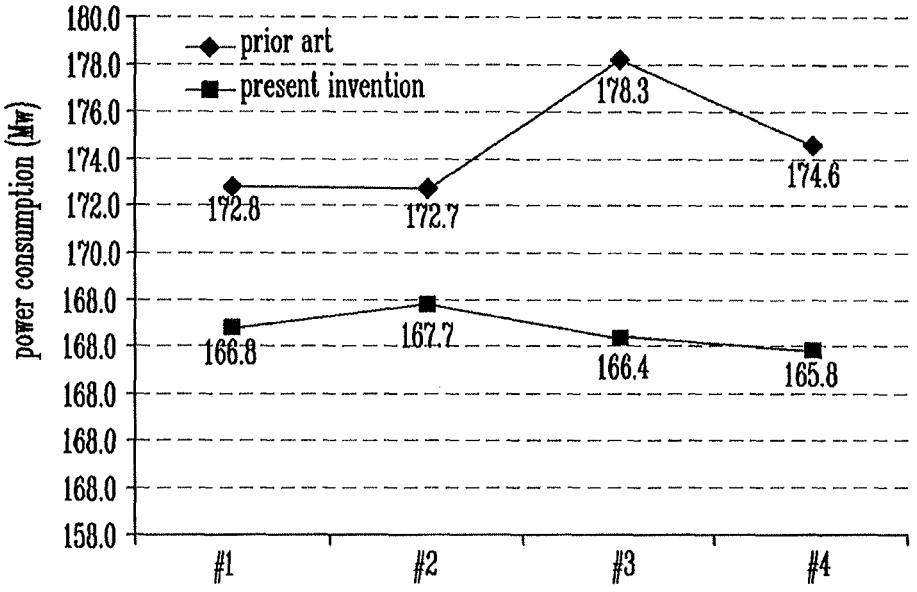
FIG. 8 illustrates an example of driving power consumption in accordance with one embodiment.

FIG. 8 is a graph illustrating an example of driving power consumption of an organic light emitting display device when a gamma reference voltage is set according to a gamma reference voltage setting method according to one or more embodiments described herein.

Referring to FIG. 8, it may be confirmed that, compared with a case in which the same gamma reference voltage VREG1 is collectively set for a plurality of organic light emitting display devices 300, when the optimal gamma reference voltage VREG1 is set for each organic light emitting display device 300 according to one or more embodiments described herein, driving power consumption of the organic light emitting display device 300 is reduced by about 5%. The driving power consumption may be a different percentage on other embodiments.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The controllers, units, and other processing features may be implemented in logic which, for example, may include hardware, software, or both. When implemented at least partially in hardware, the controllers, units, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, units, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, an organic light emitting display generates images based on data voltages applied to pixel electrodes. The data voltages are generated based on gamma voltages that reflect the gamma characteristics of the display. For example, a gray voltage corresponding to gradation of input image data may be output as a data voltage. The gray voltage may be generated based on a gamma reference voltage.

FIG. 1 illustrates an example of a gamma reference voltage and an ON/OFF voltage of a transistor (e.g., VGL/VGH in case of using PMOS) in one type of an organic light emitting display. The gamma reference voltage and ON/OFF voltage of the transistor determine the width of a voltage swing according to Equation 1 and thus are direct factors in determining dynamic power.

$$\text{Dynamic power} = C \times \Delta V^2 \times f \quad (1)$$

In Equation 1, C denotes capacitance, V denotes a set voltage, and f denotes a frequency.

In one type of device, a single gamma reference voltage is commonly set on grounds that all the organic light emitting display devices (cells) have the same gamma characteristics. However, due to various factors, the gamma characteristics of organic light emitting displays have variations. Thus, the gamma reference voltage may be set based on an expected worst condition of an organic light emitting display.

Figure 2:
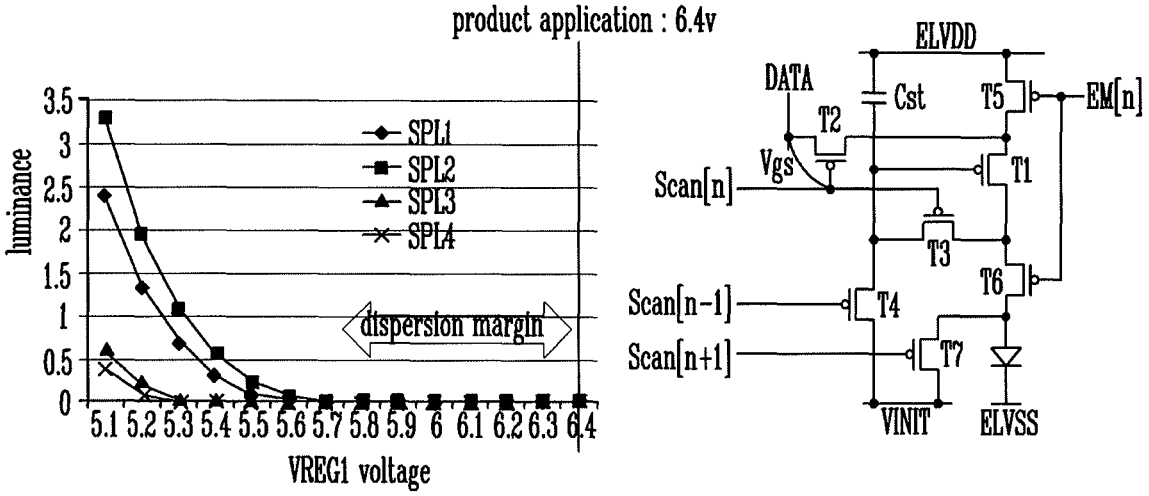
FIG. 2 (Related Art)
FIG. 2 illustrates one type of method for setting a gamma reference voltage.

FIG. 2 illustrates an example of a gamma reference voltage set to an overload value based on the understanding that luminance dispersions are different because organic light emitting displays have different black voltages. Also, the ON/OFF voltage of each transistor is set by adding a margin value of 0.1 to 0.2V to the gamma reference voltage. As a result, image quality is degraded and reliability of the organic light emitting display is adversely affected.

In accordance with one or more of the aforementioned embodiments, an organic light emitting display device is provided in which an optimal or other predetermined gamma reference voltage and a transistor ON/OFF voltage are individually and differently set for each of a plurality of organic light emitting display devices. A method for setting a gamma reference voltage of the organic light emitting display device is also provided.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments as set forth in the following claims.

What is claimed is:

1. A method for setting a gamma reference voltage of an organic light emitting display device, the method comprising:

setting the gamma reference voltage to a first temporary value;

increasing the first temporary value stepwise by a first delta value until luminance of the organic light emitting display device is less than a preset reference luminance value, the preset reference luminance value corresponding to a black voltage of the organic light emitting display device at which measured luminance is sufficiently low to display black;

setting the increased first temporary value as a second temporary value; and setting the gamma reference voltage by adding a preset offset value to the second temporary value, the preset offset value being set as an amount for compensating for a difference between a measured black voltage that exists when luminance of the organic light emitting display device is greater than 0 and a black voltage that exists when luminance of the organic light emitting display device is 0, wherein the gamma reference voltage is set to be different for each of a plurality of organic light emitting display devices, and wherein the first delta value is set by taking into consideration an accuracy of the black voltage measurement, and a measurement time of the black voltage.

2. The method as claimed in claim 1, wherein the first temporary value is 5V.

3. The method as claimed in claim 1, wherein the preset reference luminance value is 0.01.

4. The method as claimed in claim 1, wherein the first delta value is 0.1V.

5. The method as claimed in claim 1, wherein increasing the first temporary value includes:

measuring luminance of the organic light emitting display device when the gamma reference voltage is the first temporary value;

if the measured luminance is not less than the preset reference luminance value, increasing the first temporary value by the first delta value; and measuring luminance of the organic light emitting display device when the gamma reference voltage corresponds to the first temporary value increased by the first delta value.

6. The method as claimed in claim 1, wherein the preset offset value is previously set as a value to compensate a difference between the second temporary value, at which luminance of the organic light emitting display device is less than the preset reference luminance value, and a third temporary value, at which luminance of the organic light emitting display device is 0.

7. The method as claimed in claim 1, wherein, after increasing the first temporary value, the method further includes decreasing the first temporary value stepwise by a second delta value until luminance of the organic light emitting display device is greater than or equal to the preset reference luminance value.

8. The method as claimed in claim 7, wherein the second delta value is less than the first delta value.

9. The method as claimed in claim 1, further comprising setting a transistor voltage of the organic light emitting display device by adding a preset margin value to the set gamma reference voltage.

10. The method as claimed in claim 9, wherein the transistor voltage is a transistor OFF voltage.

11. The method as claimed in claim 10, wherein the transistor is a PMOS transistor.

12. An organic light emitting display device, comprising:

a display panel including a plurality of pixels connected to a plurality of data lines and a plurality of scan lines crossing the data lines;

a gamma reference voltage setter to set a gamma reference voltage;

a gamma reference voltage generator to generate a gamma reference voltage set by the gamma reference voltage setter;

a gamma voltage generator to generate a gamma voltage based on the gamma reference voltage; and a data driver to provide a data voltage generated based on the gamma voltage to a corresponding one of the data lines, wherein the gamma reference voltage setter is configured to set the gamma reference voltage to a first temporary value, increase the first temporary value stepwise by a first delta value until luminance of the display panel is less than a preset reference luminance value, set the increased first temporary value as a second temporary value, and set the gamma reference voltage by adding a preset offset value to the second temporary value, the preset offset value being set as an amount for compensating for a difference between a measured black voltage that exists when luminance of the organic light emitting display device is greater than 0 and a black voltage that exists when luminance of the organic light emitting display device is 0, wherein the preset reference luminance value corresponds to a black voltage of the organic light emitting display device at which measured luminance is sufficiently low to display black, wherein the gamma reference voltage is set to be different for each of a plurality of organic light emitting display devices, and wherein the first delta value is set by taking into consideration an accuracy of the black voltage measurement, and a measurement time of the black voltage.

13. The display device as claimed in claim 12, wherein the first delta value is 0.1V.

14. The display device as claimed in claim 12, wherein the preset offset value is previously set as a value to compensate a difference between the second temporary value, at which luminance of the organic light emitting display device is less than the preset reference luminance value, and a third temporary value, at which luminance of the organic light emitting display device is 0.

15. The display device as claimed in claim 12, wherein, after increasing the first temporary value, the gamma reference voltage setter is configured to decrease the first temporary value stepwise by a second delta value until luminance of the organic light emitting display device is greater than or equal to the preset reference luminance value.

16. The display device as claimed in claim 15, wherein the second delta value is a value less than the first delta value.

17. The display device as claimed in claim 12, wherein the gamma reference voltage setter is configured to set a transistor voltage of the organic light emitting display device by adding a preset margin value to the set gamma reference voltage.

18. A controller, comprising:

a processor to set a gamma reference voltage;

a gamma reference voltage generator to generate a gamma reference voltage set by the processor; and a gamma voltage generator to generate a gamma voltage based on the gamma reference voltage, wherein the processor is configured to set the gamma reference voltage to a first temporary value, increase the first temporary value stepwise by a first delta value until luminance of a display panel is less than a preset reference luminance value, set the increased first temporary value as a second temporary value, and set the gamma reference voltage by adding a preset offset value to the second temporary value, the preset offset value being set as an amount for compensating for a difference between a measured black voltage that exists when luminance of an organic light emitting display device is greater than 0 and a black voltage that exists when luminance of the organic light emitting display device is 0, wherein the preset reference luminance value corresponds to a black voltage of an organic light emitting display device at which measured luminance is sufficiently low to display black, wherein the gamma reference voltage is set to be different for each of a plurality of organic light emitting display devices, wherein the first delta value is set by taking into consideration an accuracy of the black voltage measurement, and a measurement time of the black voltage.

* * * * *